US010041326B2

(12) United States Patent
Jurgensmeier

(10) Patent No.: US 10,041,326 B2
(45) Date of Patent: Aug. 7, 2018

(54) SEALING PLUG AND METHOD OF REMOVING SAME FROM A WELL

(71) Applicant: Halliburton Energy Services, Inc., Houston, TX (US)

(72) Inventor: Michael James Jurgensmeier, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 58 days.

(21) Appl. No.: 15/314,680

(22) PCT Filed: Aug. 22, 2014

(86) PCT No.: PCT/US2014/052276

§ 371 (c)(1),
(2) Date: Nov. 29, 2016

(87) PCT Pub. No.: WO2016/028311

PCT Pub. Date: Feb. 25, 2016

(65) Prior Publication Data

US 2017/0198545 A1 Jul. 13, 2017

(51) Int. Cl.

| | |
|---|---|
| ***E21B 23/01*** | (2006.01) |
| ***E21B 33/128*** | (2006.01) |
| ***E21B 33/129*** | (2006.01) |
| ***E21B 34/10*** | (2006.01) |
| ***E21B 43/26*** | (2006.01) |
| *E21B 34/00* | (2006.01) |
| *E21B 43/14* | (2006.01) |

(52) U.S. Cl.

CPC ..... *E21B 33/1293* (2013.01); *E21B 23/01* (2013.01); *E21B 33/128* (2013.01); *E21B 34/10* (2013.01); *E21B 43/26* (2013.01); *E21B 43/14* (2013.01); *E21B 2034/002* (2013.01)

(58) Field of Classification Search

CPC .... E21B 33/1293; E21B 33/128; E21B 23/01; E21B 34/10; E21B 43/26; E21B 43/14; E21B 2034/002

See application file for complete search history.

(56) References Cited

U.S. PATENT DOCUMENTS

| | | | |
|---|---|---|---|
| 3,189,096 | A | 6/1965 | Phenix |
| 3,958,641 | A | 5/1976 | Dill et al. |
| 7,328,750 | B2 | 2/2008 | Swor et al. |

(Continued)

FOREIGN PATENT DOCUMENTS

| | | | |
|---|---|---|---|
| WO | 2004070163 | A1 | 8/2004 |
| WO | 2012174101 | A2 | 12/2012 |

OTHER PUBLICATIONS

International Search Report and Written Opinion dated May 22, 2015, filed in corresponding PCT Application No. PCT/US2014/052276.

*Primary Examiner* — D. Andrews
*Assistant Examiner* — Yanick A Akaragwe
(74) *Attorney, Agent, or Firm* — McAfee & Taft

(57) ABSTRACT

A plug for sealing a well in oil and gas recovery operations, and a method of removing the plug from the well is provided. The method is an erosion method of dislodging the plug from the wellbore, and the plug is designed so as to better be removed through erosion. The plug includes a jetting component to direct an abrasive fluid during the erosion method.

15 Claims, 4 Drawing Sheets

(56) References Cited

U.S. PATENT DOCUMENTS

| | | | | |
|---|---|---|---|---|
| 9,004,172 | B2 * | 4/2015 | Carlson | E21B 43/267 166/177.5 |
| 9,359,863 | B2 | 6/2016 | Streich et al. | |
| 2005/0205264 | A1 | 9/2005 | Starr et al. | |
| 2011/0067889 | A1 * | 3/2011 | Marya | E21B 33/134 166/386 |
| 2011/0240295 | A1 | 10/2011 | Porter et al. | |
| 2012/0279700 | A1 | 11/2012 | Frazier | |
| 2012/0318513 | A1 | 12/2012 | Mazyar et al. | |
| 2014/0158357 | A1 * | 6/2014 | Lyashkov | E21B 34/063 166/297 |
| 2016/0024874 | A1 | 1/2016 | Johnson et al. | |

* cited by examiner

SEALING PLUG AND METHOD OF REMOVING SAME FROM A WELL

FIELD

This application relates to a plug for sealing a well in oil and gas recovery operations, and a method of removing the plug from the well.

BACKGROUND

Hydraulic fracturing processes (also referred to in the art as "fracking") are used to break up reservoir rock. During fracking operations, a packer assembly having a one-way valve is often used to isolate reservoirs and/or production zones by sealing off lower zones in a borehole in order to carry out a hydraulic fracturing process on higher zones. Packer assemblies using such one-way valves are generally referred to as "frac plugs". Often fracking operations will use multiple frac plugs so as to isolate several zones so as to carry out fracking of such zones in different stages.

A packer assembly provides a seal between the outside of the frac plug and inside of the casing so as to prevent fluid flow outside of tubing utilized in well operations. A packer assembly may allow for fluid flow through its mandrel and hence through the tubing to which it is connected. In a frac plug, the one-way valve provides for one-directional flow upward through the tubing by governing flow through the mandrel of the frac plug, which is in fluid flow communication with the tubing.

Frac plugs can utilize various valves to provide for one-way directional flow through the packer assembly, such as ball/ball seat assemblies and poppet valve assemblies. Where ball/ball seat assemblies are used, the Frac plug has two-way directional flow (upward and downward) prior to introduction of the ball. The ball can be introduced by dropping it downhole and subsequently introducing it to the ball seat by gravity and/or fluid pressure. In poppet valve assemblies, downward flow through the packer assembly can be initially provided by propping open the poppet valve. When downward flow is no longer desired, backflow (upward flow) through the poppet valve can be used to release the prop and, thus, activate the valve to prevent downward flow.

After the fracking operation, the frac plugs are then removed to allow fluid flow to or from the fractured rock. Some frac plugs are designed to be removed by lowering a tool downhole to disengage the frac plug and return it up hole; however, such removal is more costly and time consuming than other removal methods. More typically, frac pugs are made of drillable composites and/or metal and are removed by drilling them out of the borehole. In some cases, the frac plug elements have been formed of a material that reacts with the ambient downhole environment so that they need not be physically removed by the aforementioned mechanical operations, but may instead corrode or dissolve under downhole conditions. However, because operations such as fracking may not be undertaken for months after the borehole is drilled, such elements may have to be immersed in downhole fluids for extended periods of time (for example, up to a year, or longer) before the fracking operation begins. Therefore, use of dissolvable components can be problematic because the frac plug may become inoperable before fracking commences.

BRIEF DESCRIPTION OF THE DRAWINGS

In FIG. 3, the jetting component is shown as transparent in order to better display its features.

DETAILED DESCRIPTION

Figure 1:
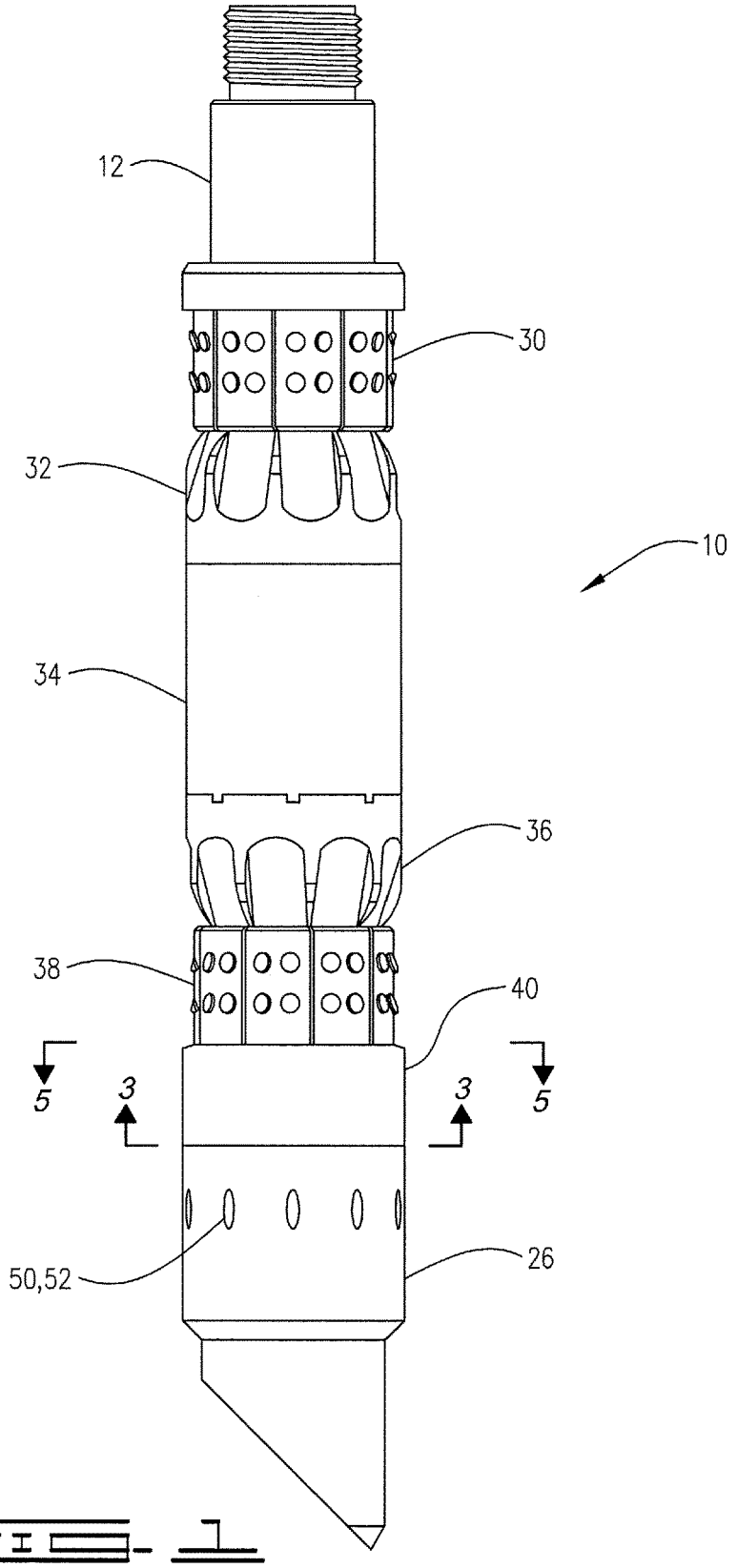
FIG. 1 is a front elevation view of a frac plug in accordance with one embodiment.

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. In the following description, the terms "upper," "upward," "lower," "below," "downhole" and the like, as used herein, shall mean: in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

Generally, this disclosure relates to a process and apparatus for dislodging a downhole tool from a wellbore. The invention is applicable to wellbores with casing and "wellbore" as used herein will generally mean either the wellbore without a casing or with a casing. The embodiments are particularly applicable to dislodging a packer-type tool and more particularly to dislodging a frac plug after fracturing operations where the frac plug was used to isolate well zones during fracturing operations. The embodiments herein are described in relation to frac plugs; but it will be understood that uses for other downhole tools, such as packers, is within the scope of the invention.

In the process, an abrasive fluid is used to erode away portions of the frac plug. Typically, a jetting component is used to direct and intensify the abrasive fluid so as to enhance the erosion. Turning now to the figures, an apparatus suitable for use in the process will now be described.

Figure 2:
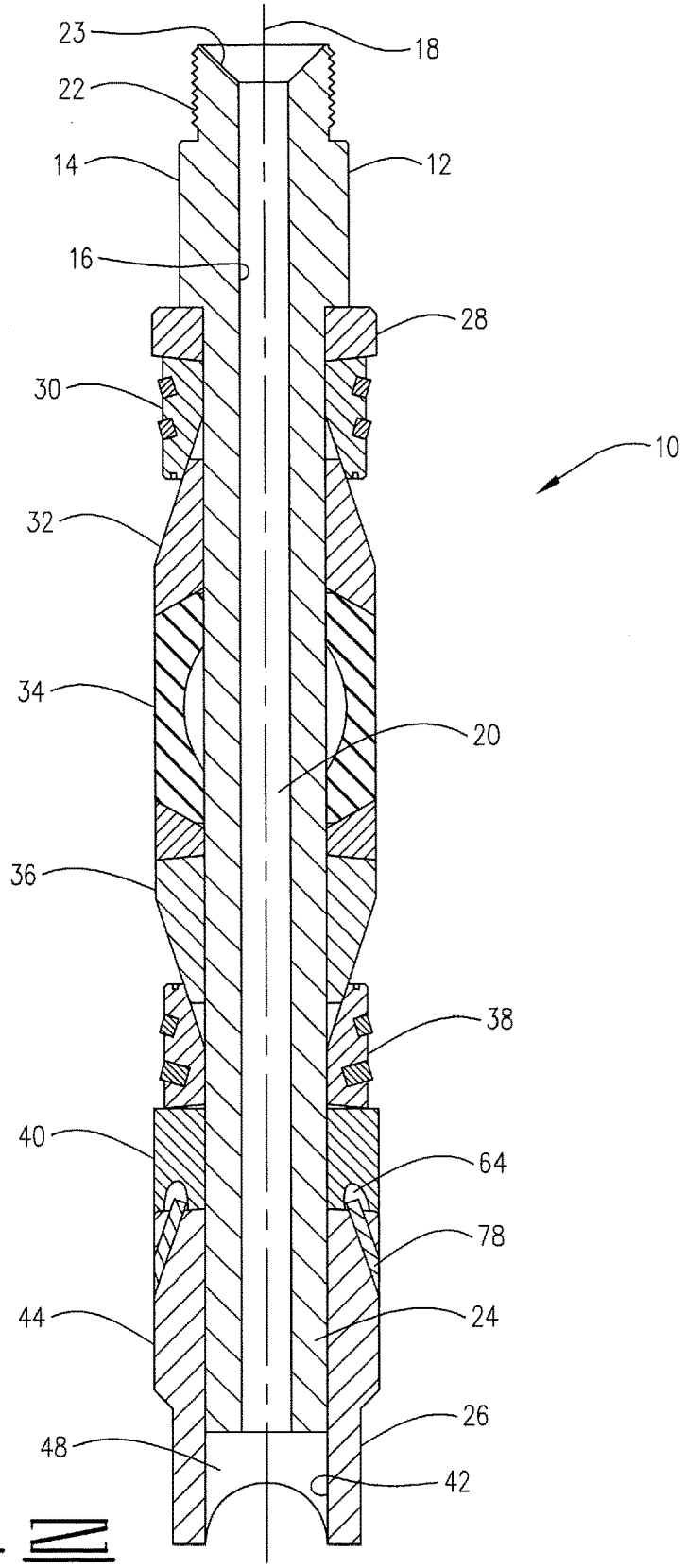
FIG. 2 is a schematic cross-sectional view of the frac plug of FIG. 1.

In FIGS. 1 and 2, a frac plug 10 having a jetting component 40 is illustrated. Frac plug 10 is of a packer type. Packers typically have at least one means for allowing fluid communication there through. Frac plugs typically have a valve, such as a ball/ball seat valve, such that fluid communication or flow in one direction can be prevented. Frac plug 10 has a mandrel 12 having an outer surface 14, an inner surface 16, and a longitudinal central axis or longitudinal axial centerline 18. Also, as referred to herein, the term "radially" will refer to a radial direction perpendicular to the longitudinal axial centerline 18 and "longitudinal" or "axial" will refer to a direction parallel to the longitudinal axial centerline 18.

Mandrel 12 has central bore 20, an upper end 22 and a lower end 24. Upper end 22 will typically be a neck and, as illustrated, is a threaded neck. "Neck" as used herein means that it is a section that is suitable for connecting to a setting tool, drill string, downhole tubing or other downhole string. Typically, the connection can involve the string engaging into the neck and/or around the outside of the neck. In the illustrated embodiment, upper end 22 has a ball seat 23, which is suitable for receiving a ball plug (not shown) in sealing relation. When the ball plug is introduced, fluid flow upward through central bore 20 is allowed; but downward flow into and through central bore 20 is not allowed. Mandrel 12 terminates at its lower end 24 in a shoe 26.

Frac plug 10 includes a slip assembly, comprising upper retaining ring 28, upper slip ring 30, upper slip wedge 32, lower slip wedge 36 and lower slip ring 38, all of which are positioned circumferentially about packer mandrel 12. Frac plug 10 includes as sealing assembly, shown as expandable sealing element 34, which is sandwiched between upper slip wedge 32 and lower slip wedge 36. The slip assembly serves to anchor the frac plug in the wellbore, and the sealing assembly serves to seal the frac plug against fluid flow through the annulus between the outer surface of the frac plug and the casing or wellbore wall.

Upper retaining ring 28 adjacent to upper end 22, which can be secured to packer mandrel 12 by pins, provides an abutment serving to axially retain upper slip ring 30 from upward movement. Upper slip ring 30 may be composed of slip segments positioned circumferentially around packer mandrel 12 in order to form the upper slip ring 30. Slip retaining bands can be used to radially retain upper slip ring 30 in an initial circumferential position about packer mandrel 12, as well as upper slip wedge 32. The bands can be made of a steel wire, a plastic material, or a composite material having the requisite characteristics of having sufficient strength to hold the upper slip ring 30 in place prior to actually setting frac plug 10. Upper slip wedge 32 is initially positioned in a slidable relationship to, and partially underneath, upper slip ring 30, as shown in FIG. 1B. Examples of suitable slip rings are described in U.S. Pat. No. 5,540,279.

Typically, upper slip wedge 32 will be designed as a partial cone so as to provide a ramp or wedge for splitting and radially expanding upper slip ring 30 when frac plug 10 is moved into its set position. Upper slip wedge 32 abuts expandable sealing element 34, located below upper slip wedge 32.

Located below upper slip wedge 32 is expandable sealing element 34. The frac plug 10 includes at least one such expandable sealing element but can include two, three or more such elements. Expandable sealing element 34 has unset and set positions corresponding to the unset and set positions of frac plug 10, respectively. Expandable sealing element 34 is radially expandable from the unset position to the set position in response to the application of axial force on expandable sealing element 34. In the set position, the expandable sealing element 34 engages an inner wall of a casing in the wellbore to create a seal to prevent flow through annulus between frac plug 10 and the casing. Limiter rings can be positioned at the upper and lower ends of expandable sealing element 34 so as to limit longitudinal or axial expansion of expandable sealing element 34 when frac plug 10 is moved into its set position.

Upper slip wedge 32 is disposed at the upper end of expandable sealing element 34. There is a lower slip wedge 36 disposed at the lower end of expandable sealing element 34. Lower slip wedge 36 is similar to upper slip wedge 32 but oriented opposite to upper slip wedge 32. As shown, the upper end of expandable sealing element 34 resides directly against the abutting lower end of upper slip wedge 32. Additionally, the lower end of expandable sealing element 34 resides directly against the abutting upper end of lower slip wedge 36.

Located below lower slip wedge 36 is lower slip ring 38. Lower slip wedge 36 is similar to upper slip wedge 32. Lower slip wedge 36 and lower slip ring 38 interact as described above for upper slip wedge 32 and upper slip ring 30. The lower end of upper slip ring 30 abuts jetting component 40, which in turn abuts shoe 26 so as to be retained from downward axial movement.

When moved from its unset position to its set position under a setting force, upper retaining ring 28 is moved towards shoe 26 shearing any pins restraining upper retaining ring 28. This movement causes axial pressure to be exerted on the intervening components. Accordingly, upper slip ring 30 is pressed against the wedge surface of upper slip wedge 32 and is thereby radially expanded so that the outer surface of upper slip ring 30 contacts the inner wall of the casing. Similarly, lower slip ring 38 is pressed against the wedge surface of lower slip wedge 38 and is thereby radially expanded so that the outer surface of lower slip ring 38 contacts the inner wall of the casing. Typically, the outer surface of the slip rings will have buttons, wickers or similar that bite into the casing wall and thus anchor frac plug 10 to the casing. Also during setting of frac plug 10, upper slip wedge 32 and lower slip wedge 36 transfer the setting force to expandable sealing element 34, causing it to radially expand outward so as to come into sealing engagement with the inner wall of the casing. The sealing engagement prevents fluid flow past in the annulus between frac plug 10 and the casing wall.

With reference to FIGS. 2 to 6, the jetting component 40 and shoe 26 will now be further described. As can best be seen from FIG. 5, shoe 26 has an inside surface 42, an outside surface 44 and an upper surface 46. Inside surface 42 defines a central bore 48, which is in fluid flow contact with central bore 20 of mandrel 12. Central bore 48 allows fluid flow from central bore 20 to the area below frac plug 10.

Flow ports 50 extend through a portion of shoe 26. Flow ports 50 terminate at one end in entry orifices 52 on a side surface of shoe 26. Entry orifices 52 can be on inside surface 42 or on outside surface 44. If located on inside surface 42, entry orifices 52 are configured to have fluid flow communication with central bore 20 or central bore 48. As shown, entry orifices 52 are on outside surface 44 and are in fluid flow communication with the annulus between frac plug 10 and the casing. Through the annulus, entry orifices 52 are in fluid flow communication with the area below frac plug 10. Flow ports terminate at a second end at exit orifices 54 on upper surface 46.

Jetting component 40 is a ring having an outer surface 56, an inner surface 58, an upper surface 60 and a lower surface 62. Inner surface 58 is configured to receive mandrel 12 in sliding relationship such that jetting component 40 can spin or rotate about mandrel 12. Jetting component 40 has angled passages 64 extending from a lower surface 62 to an upper surface 60. Angled passages 64 are tapered so that they are narrower at upper surface 60 than at lower surface 62, thus creating a jetting effect for fluid flowing through angled passages 64 towards upper surface 60; that is, as fluid flows upwards through angled passages 64, the fluid flow rate increases to compensate for the smaller cross-sectional area of angled passages 64.

Figure 3:
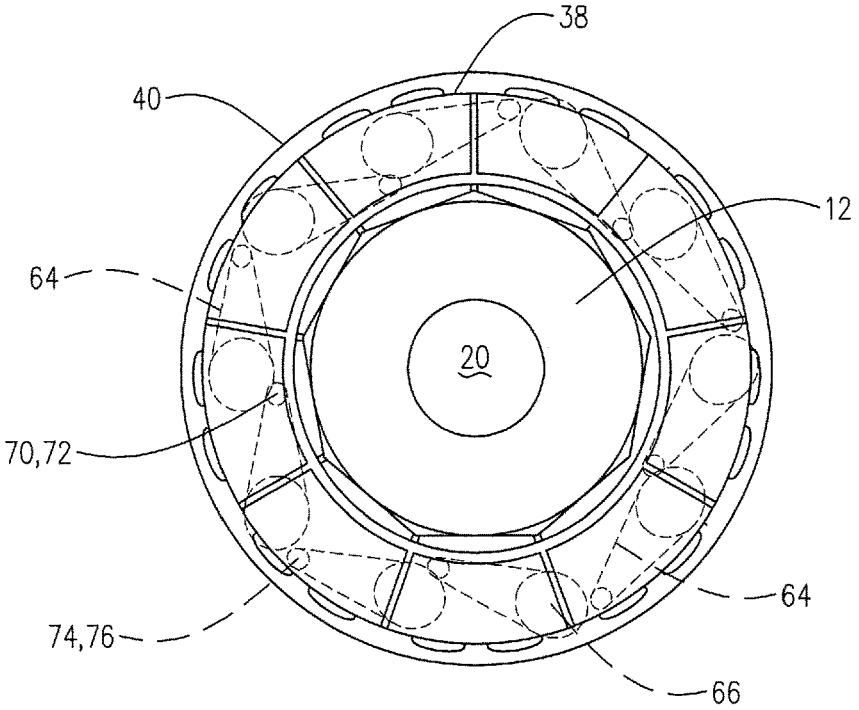
FIG. 3 is a sectional view taken along line 3-3 of FIG. 1.
Figure 4:
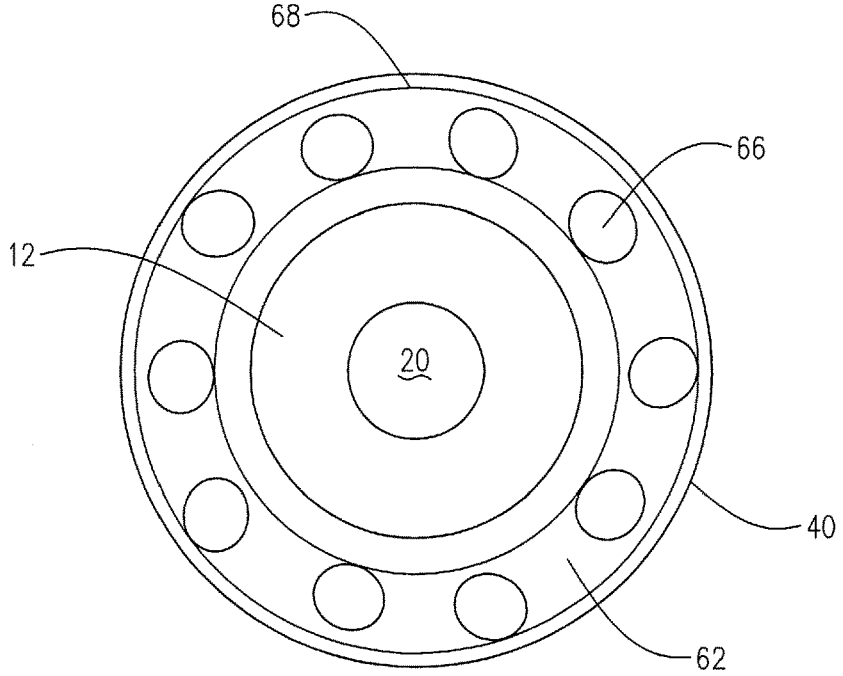
FIG. 4 is a sectional view taken along line 3-3 of FIG. 1, where the jetting component is shown as opaque, thus showing the lower surface of the jetting component.

As best seen from FIGS. 3 and 4, at lower surface 62, angled passages 64 have an entry orifice 66, which lie evenly spaced about a circle centered on longitudinal central axis 18. Entry orifices 66 can lie within a circular channel 68 to aid in introducing fluid from flow ports 50 to angled passages 64. Alternatively, a circular channel can lie concentrically about upper surface 46 of shoe 26.

Figure 5:
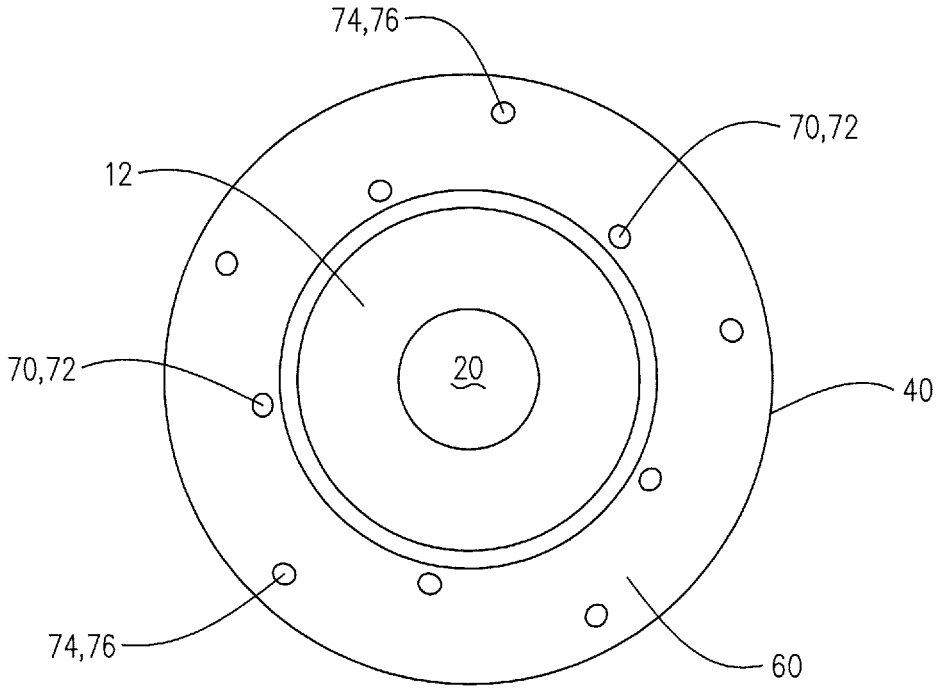
FIG. 5 is a sectional view taken along line 5-5 of FIG. 1, thus showing the upper surface of the jetting component.

As can be seen from FIGS. 3 and 5, a first portion 70 of the angled passages 64 are angled radially inward so that they have an exit orifice 72 lying adjacent to inner surface 58 and, hence, mandrel 12. A second portion 74 of angled passages 64 are angled radially outward so that they have an exit orifice 76 lying adjacent to outer surface 56. Additionally, angled passages 64 are at an angle to longitudinal axial centerline 18 so that for each angled passages 64, exit orifice 72 or 76 is behind entry orifice 66 in a counterclockwise direction. When fluid flows upward through angled passages 64, this counterclockwise angling results in the jetting component spinning counterclockwise. Alternatively, each angled passages 64 can be angled such that exit orifice 72, 76 is ahead of entry orifice 66 in a clockwise direction to thus result in a counterclockwise spinning of the jetting component.

Figure 6:
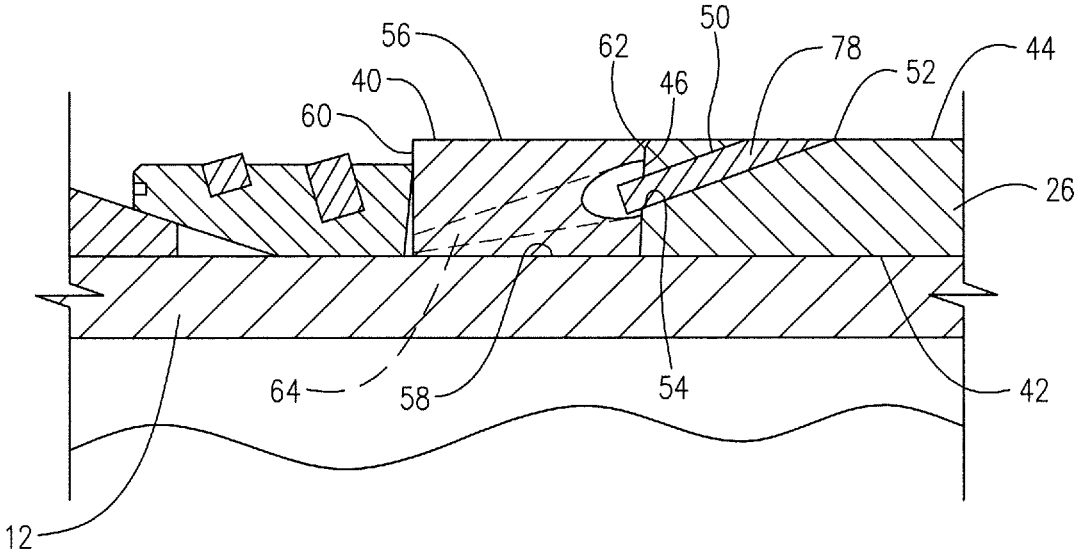
FIG. 6 is an enlargement of the jetting component area of the cross-sectional view of FIG. 2.

Prior to activation of the jetting component, as described below, it may be desirable to prevent jetting component 40 from rotating about mandrel 12. As illustrated in FIGS. 2 and 6, a dissolvable pin 78 can be introduced into flow ports 50 such that they extend at least partially through flow ports 50 and at least partially into angled passages 64. Thus, dissolvable pin 78 prevents rotation of jetting component 40 and can prevent fluid flow through flow ports 50 into angled passages 64.

In an alternative embodiment, shoe 26 will not have flow ports. In this embodiment, jetting component 40 will have angled passages that have entry orifices on outside surface 44 adjacent to lower surface 62. A plate can cover jetting component 40 to prevent rotation and jetting of fluid prior to activation of the jetting component 40. The plate can have erosion points that will readily erode during flow back of the abrasive fluid and, thus, activate the jetting component so as to provide rotation and jetting of fluid. Alternatively, the jetting component can be kept from rotating by brass or dissolvable screws.

Generally, the abrasive fluid used in a process for eroding the frac plug can be the fluid used in a fracking operation. Examples of such an abrasive fluids are sand/water mixtures. Typically, the sand/water mixtures can have a concentration of sand from 0.25 pounds per gallon (PPG) to 1 PPG water. Generally, at least 80% of the slip rings and mandrel are erodible material and at least 90% of the slip rings and mandrel can be erodible material. Typically, a major part of the mandrel, slip rings, slip wedges, retaining ring and shoe will be erodible material. More typically, most of the components of the frac plug can be substantially composed of erodible material. For example, at least 80% of the mandrel, slip rings, slip wedges, retaining ring and shoe can be erodible material and more preferably at least 90% of the mandrel, slip rings, slip wedges, retaining ring and shoe can be erodible material. Erodible materials as used herein refer to materials that will erode under a flow of the abrasive material. Exemplary materials are composite materials such as engineered plastics. Specific plastics include nylon, phenolic materials and epoxy resins. The phenolic materials may further include any of Fiberite FM4056J, Fiberite FM4005 or Resinoid 1360. The plastic components may be molded or machined. Dissolvable pin 78 and/or dissolvable screws can be composed of a material that will readily dissolve in the abrasive fluid. For example, dissolvable pins can be made from polyglycolide (PGA) or from various dissolving metals known to those skilled in the art. The plate covering the jetting component, if used, can be made in all or part from erodible material. The expandable sealing element can be comprised of elastomeric material such as, for example, elastomers sold under the trademarks VITON or FKM (Vicon).

A method of fracking and dislodging a downhole tool, such as the above described frac plug, can be carried out as follows. A first or lowest erodible downhole tool or frac plug is introduced into the wellbore at predetermined location to thus separate two zones to undergo hydraulic fracturing or fracking operations. A pressurized abrasive fluid is introduced into the wellbore under sufficient pressure to cause fracturing of the surrounding reservoir below the lowest frac plug. After fracturing below the lowest frac plug has occurred, a ball plug is introduced downhole to isolate the zone below the lowest frac plug from fluid flow from above the lowest frac plug. Next, a second frac plug can be introduced to separate the zone between the lowest frac plug and the second frac plug ("second zone") from the zone above the second frac plug. Additional pressurized abrasive fluid can be introduced at a pressure sufficient to fracture the second zone. Afterwards, a ball plug can be introduced downhole to the second frac plug to isolate the second zone from fluid flow from above the second frac plug. Subsequent frac plugs can be introduced and fracturing can be carried out as needed to fracture additional zones. Alternatively, all the frac plugs can be introduced prior to any fracturing as long as the frac plugs can be sequentially closed from downward fluid flow as necessary to support sequential fracturing of the zones.

Once the zones have been fractured, fluid pressure above the frac plugs is reduced to below the fluid pressure below the frac plugs to thus create a pressure differential. This pressure differential results in a backflow of abrasive fluid up the wellbore. Because of the one-directional valve of the frac plugs, the backflow of abrasive fluid is allowed to pass up through the frac plugs. The backflow of abrasive fluid causes dissolution of the dissolvable pins, which allows fluid flow through the flow ports of the shoe and, thus, fluid flow into and through the angled passages of the jetting component. This fluid flow through the angled passages activates the jetting component. The tapered structure of the angled passages causes an increased velocity of the fluid flowing there through, hence, "jetting" the abrasive fluid out of the exit orifices of the jetting component. This jetting action, along with the angled nature of the passages, causes the jetting component to spin or rotate about the mandrel of the frac plug, thus, insuring application of the abrasive fluid about the circumference of the frac plug. A first portion of the angled passages directs abrasive fluid towards the mandrel and a second portion of the angled passages directs abrasive fluid towards the slip rings and, typically, the outer portion of the slip rings that grip the casing. The flow of jetted abrasive fluid erodes the slip assembly and mandrel, thus, dislodging the frac plug from its position in the wellbore. In some applications, it can be desirable to retard the erosion of the mandrel, thus, allowing the jetting component to stay attached to the frac plug during erosion and even to move up the mandrel during erosion of the slip assembly. For such applications, the outer surface of the mandrel can be coated with an erosion resistant material. Additionally, the flow ports of the shoe can be coated with an erosion resistant material or have erosion resistant inserts. The jetting component can be made out of erosion resistant material or can have erosion resistant coating or inserts in its angled passages. Suitable erosion resistant materials include steel, austenitic nickel-chromium based super alloys (such as INCONEL alloy 718), and various nanostructured tungsten carbide-based alloys, such as those distributed by Hardide Coatings. Generally, to achieve sufficient erosion, the backflow of abrasive material can generally be above 10 barrels per minute (BPM) and will typically be at least 25 BPM.

In accordance with the above description, there is provided in one embodiment a downhole tool for use in a wellbore. The downhole tool comprises a mandrel, a slip assembly, a sealing element, a shoe and a jetting component. The mandrel has an upper end, a lower end, an inner surface and an outer surface. The inner surface defines a central flow passage. The slip assembly is disposed on the mandrel. The slip assembly radially expands to grippingly engage the wellbore when the downhole tool is in a set position. The sealing element is disposed about the mandrel. The sealing element is radially expandable from an unset position to a set position in response to application of axial force on the sealing element. The sealing element sealingly engages the wellbore in the set position. The shoe is disposed on the lower end of the mandrel. The jetting component is disposed about the mandrel between the shoe and the slip assembly. The jetting component is configured to direct fluid to the slip assembly.

The jetting component can have angled passages through which fluid can flow and be directed. Further, the angled passages can be configured such that when fluid flows through the angled passages, the jetting component spins about the mandrel. Also, a first portion of the angled passages can direct fluid towards the slip assembly and a second portion of the angled passages can direct fluid towards the outer surface of the mandrel.

The angled passages can be configured such that when fluid flows through the angled passages, the jetting component spins about the mandrel. A first portion of the angled passages can direct fluid towards the slip assembly, and a second portion of the angled passages can direct fluid towards the outer surface of the mandrel.

The shoe can have flow ports in fluid flow communication with the angled passages, wherein fluid is introduced into the angled passages through the flow ports. The downhole tool can comprise pins lodged in the flow ports so as to prevent flow through the flow ports and into the angled passages until an abrasive fluid is flowed upward through the downhole tool. The pins can be dissolvable. The pins extend into the angled passages so as to prevent the jetting assembly from rotating until fluid flows through the ports and into the angled passages.

Further, the shoe can have an upper end, a lower end, an outer surface and an inner surface. The inner surface can define a flow passage in fluid flow communication with the central bore. The fluid ports can extend from the outer surface to the upper end; and the fluid ports can be in fluid flow communication with the angled passages at the upper end, such that fluid adjacent to the outer surface of the shoe can be introduced through the flow ports to the angled passages.

According to another embodiment, there is provided a method of dislodging a downhole tool from a wellbore in which the downhole tool is set. The method comprises:

- exposing the downhole tool to a flow of abrasive fluid wherein abrasive fluid flows through a central bore of a mandrel of the downhole tool, the mandrel having an outer surface and an inner surface and wherein the inner surface defines the central bore; and
- directing a first portion of abrasive fluid to a portion of a slip assembly disposed on the outer surface of the mandrel, wherein the slip assembly grippingly engages the wellbore to thus set the tool in the wellbore.

The directing step can involve a jetting ring disposed on the mandrel, wherein at least some of the flow of abrasive fluid is introduced into passages in the jetting ring such that the first portion of abrasive fluid is directed through a first set of the passages to the portion of the slip assembly and a second portion of abrasive fluid is directed through a second set of the passages to the outer surface of the mandrel. The flow of abrasive fluid can be at a rate of above 10 BPM or can be at a rate of at least 25 BPM.

The method can further comprise, prior to the exposing step:

- introducing the downhole tool into the wellbore to a predetermined location;
- introducing the abrasive fluid into a first portion of the wellbore below the downhole tool;
- isolating the first portion of the wellbore from fluid flow above the downhole tool; and
- fracking a reservoir adjacent to a second portion of the wellbore above the downhole tool.

The abrasive fluid in the first portion of the wellbore can be at a first pressure. The exposing step can be carried out by reducing the pressure in the second portion of the wellbore to a pressure below the first pressure to create a pressure differential such that abrasive fluid flows up through the downhole tool. The pressure differential can be sufficient to cause the flow rate of the abrasive fluid to be greater than 10 barrels per minute (BPM) or to be at least 25 BPM.

While various embodiments of the invention have been shown and described herein, modifications may be made by one skilled in the art without departing from the spirit and the teachings of the invention. The embodiments described here are exemplary only and are not intended to be limiting. Many variations, combinations, and modifications of the invention disclosed herein are possible and are within the scope of the invention. Accordingly, the scope of protection is not limited by the description set out above but is defined by the claims, which follow. The scope includes all equivalents of the subject matter of the claims.

What is claimed is:

1. A downhole tool for use in a wellbore, the downhole tool comprising:

- a mandrel having an upper end, a lower end, an inner surface and an outer surface, wherein said inner surface defines a central flow passage;
- a slip assembly disposed on said mandrel, wherein said slip assembly radially expands to grippingly engage said wellbore when said downhole tool is in a set position;
- a sealing element disposed about said mandrel, wherein said sealing element is radially expandable from an unset position to a set position in response to application of axial force on said sealing element and wherein said sealing element sealingly engages said wellbore in said set position;
- a shoe disposed on said lower end of said mandrel; and
- a jetting component disposed about said mandrel between said shoe and said slip assembly, said jetting component configured to direct fluid to said slip assembly, wherein said jetting component has angled passages through which fluid can flow and be directed and said angled passages are configured such that when fluid flows through said angled passages said jetting component spins about said mandrel.

2. The downhole tool of claim 1, wherein a first portion of said angled passages direct fluid towards said slip assembly and a second portion of said angled passages directs fluid towards said outer surface of said mandrel.

3. The downhole tool of claim 1, wherein said shoe has flow ports in fluid flow communication with said angled passages wherein fluid is introduced into said angled passages through said flow ports.

4. The downhole tool of claim 3, further comprising pins lodged in said flow ports so as to prevent flow through said flow ports and into said angled passages until an abrasive fluid is flowed upward through said downhole tool.

5. The downhole tool of claim 4, wherein said pins are dissolvable.

6. The downhole tool of claim 5, wherein said angled passages are configured such that when fluid flows through said angled passages, said jetting component spins about said mandrel and wherein a first portion of said angled passages direct fluid towards said slip assembly and a second portion of said angled passages directs fluid towards said outer surface of said mandrel.

7. The downhole tool of claim 6, wherein said pins extend into said angled passages so as to prevent said jetting assembly from rotating until fluid flows through said ports and into said angled passages.

8. The downhole tool of claim 7, wherein said shoe has an upper end, a lower end, an outer surface and an inner surface; and wherein said inner surface defines a flow passage in fluid flow communication with said central bore, said fluid ports extend from said outer surface to said upper end and said fluid ports are in fluid flow communication with said angled passages at said upper end, such that fluid adjacent to said outer surface of said shoe can be introduced through said flow ports to said angled passages.

9. A method of dislodging a downhole tool from a wellbore in which said downhole tool is set, the method comprising:

exposing said downhole tool to a flow of abrasive fluid, wherein abrasive fluid flows through a central bore of a mandrel of said downhole tool, said mandrel having an outer surface and an inner surface and wherein said inner surface defines said central bore; and directing a first portion of abrasive fluid to a portion of a slip assembly disposed on said outer surface of said mandrel, wherein said slip assembly grippingly engages said wellbore to thus set said tool in said wellbore, and wherein the directing involves a jetting ring disposed on said mandrel wherein at least some of said flow of abrasive fluid is introduced into passages in said jetting ring such that said first portion of abrasive fluid is directed through a first set of said passages to said portion of said slip assembly and a second portion of abrasive fluid is directed through a second set of said passages to said outer surface of said mandrel.

10. The method of claim 9, wherein said flow of abrasive fluid is at a rate of above 10 BPM.

11. The method of claim 10, wherein said flow of abrasive fluid is at a rate of at least 25 BPM.

12. The method of claim 10 further comprising, prior to the exposing step:

introducing said downhole tool into said wellbore to a predetermined location;

introducing said abrasive fluid into a first portion of said wellbore below said downhole tool;

isolating said first portion of said wellbore from fluid flow above said downhole tool; and fracking a reservoir adjacent to a second portion of said wellbore above said downhole tool.

13. The method of claim 12, wherein said abrasive fluid in said first portion of said wellbore is at a first pressure and wherein the exposing step is carried out by reducing the pressure in said second portion of said wellbore to a pressure below said first pressure to create a pressure differential such that abrasive fluid flows up through said downhole tool.

14. The method of claim 13, wherein said pressure differential is sufficient to cause the flow rate of said abrasive fluid to be greater than 10 BPM.

15. The method of claim 14, wherein said pressure differential is sufficient to cause the flow rate of said abrasive fluid to be at least 25 BPM.

* * * * *